US007260859B2

(12) United States Patent
Helmsderfer

(10) Patent No.: US 7,260,859 B2
(45) Date of Patent: Aug. 28, 2007

(54) BABY DIAPER CHANGING STATION

(75) Inventor: John A. Helmsderfer, 6909 Kenwood Rd., Cincinnati, OH (US) 45243

(73) Assignee: John A. Helmsderfer, Cincinnati, OH (US)

( * ) Notice: Subject to any disclaimer, the term of this patent is extended or adjusted under 35 U.S.C. 154(b) by 0 days.

(21) Appl. No.: 11/067,007

(22) Filed: Feb. 25, 2005

(65) Prior Publication Data

US 2005/0138735 A1 Jun. 30, 2005

Related U.S. Application Data

(63) Continuation of application No. 10/280,698, filed on Oct. 25, 2002, now Pat. No. 6,859,966.

(51) Int. Cl.
*A47D 5/00* (2006.01)

(52) U.S. Cl. ..... 5/655; 5/947

(58) Field of Classification Search ..... 5/655, 5/947, 133, 136; 108/38, 42; 312/242, 246
See application file for complete search history.

(56) References Cited

U.S. PATENT DOCUMENTS

| | | | |
|---|---|---|---|
| 879,050 | A | 2/1908 | Ingram et al. |
| 1,908,200 | A | 5/1933 | Webster |
| 2,174,363 | A | 9/1939 | Eubank |
| 2,735,737 | A | 2/1956 | Hancock |
| D179,871 | S | 3/1957 | Wrablica, Jr. |
| 3,656,193 | A | 4/1972 | Schneider et al. |

(Continued)

FOREIGN PATENT DOCUMENTS

| | | |
|---|---|---|
| DE | 505341 | 8/1930 |

(Continued)

OTHER PUBLICATIONS

Photographs submitted by Defendant in *Helmsderfer et al.* v. *Bobrick Washroom Equipment, Inc. et al.*; Southern District of Ohio; Case No. 1:06CV268.

*Primary Examiner*—Patricia Engle
*Assistant Examiner*—Fredrick Conley
(74) *Attorney, Agent, or Firm*—Wood, Herron & Evans, LLP

(57) ABSTRACT

A diaper changing station includes a support platform configured for supporting a child and having a bottom surface and side surfaces. The support platform is hingedly fixable at an edge with respect to a wall to move between an open position and a closed position against the wall. A panel is configured to overlie and cover at least a portion of the bottom surface and to be generally exposed when the support platform is in the closed position. A frame structure is configured to engage the bottom surface and side surfaces of the support platform for securement thereto. The frame structure secures the panel with the support platform. A lip is formed around the side surfaces of the platform. An edge of the frame structure abuts the lip when the frame structure engages the support platform to present a seamless appearance. In another aspect, the changing station includes a backer plate coupled to the base and having a cleat. Another backer plate is mounted to a wall and has a cleat. The station backer plate is positioned to engage the cleat of the wall backer plate for supporting the base when the diaper changing station is mounted to a wall.

13 Claims, 8 Drawing Sheets

U.S. PATENT DOCUMENTS

| | | | | |
|---|---|---|---|---|
| 3,693,293 | A | | 9/1972 | Egan, Jr. et al. |
| D243,048 | S | | 1/1977 | Touchett et al. |
| D243,213 | S | | 2/1977 | Kormos |
| D246,682 | S | | 12/1977 | Nakao |
| 4,074,635 | A | | 2/1978 | Stauble |
| D248,805 | S | | 8/1978 | Bridges |
| D249,991 | S | | 10/1978 | Bridges |
| 4,125,192 | A | | 11/1978 | Dayen |
| D250,800 | S | | 1/1979 | Trossman |
| 4,133,063 | A | | 1/1979 | Jones-Steele |
| D251,039 | S | | 2/1979 | Reppas |
| 4,205,669 | A | | 6/1980 | Hamann |
| D255,734 | S | | 7/1980 | Liebman |
| 4,216,951 | A | | 8/1980 | Griffin |
| D260,827 | S | | 9/1981 | Sommer |
| D263,532 | S | | 3/1982 | Ferdinand et al. |
| D265,703 | S | | 8/1982 | Zaro |
| D267,843 | S | | 2/1983 | Sundberg |
| D272,402 | S | | 1/1984 | Marrujo |
| D274,105 | S | | 6/1984 | Brescia et al. |
| D277,819 | S | | 3/1985 | Crosslen |
| 4,522,381 | A | | 6/1985 | Ludwick |
| 4,527,830 | A | | 7/1985 | Meyers |
| 4,573,608 | A | | 3/1986 | Hansen |
| D283,189 | S | | 4/1986 | Hampton |
| D284,530 | S | | 7/1986 | Riehm |
| D284,531 | S | | 7/1986 | Riehm |
| D284,723 | S | | 7/1986 | Morris et al. |
| 4,613,996 | A | | 9/1986 | Chase et al. |
| D287,200 | S | | 12/1986 | Gecchelin |
| D287,318 | S | | 12/1986 | Garduno |
| 4,633,789 | A | | 1/1987 | Kortering et al. |
| 4,648,766 | A | | 3/1987 | Wollar |
| D293,403 | S | | 12/1987 | Umanoff et al. |
| D293,404 | S | | 12/1987 | Murphy |
| 4,712,258 | A | | 12/1987 | Eves |
| D294,096 | S | | 2/1988 | Murphy |
| 4,723,493 | A | | 2/1988 | Siani et al. |
| D295,007 | S | | 4/1988 | Hardy et al. |
| 4,788,726 | A | | 12/1988 | Rafalko |
| 4,796,314 | A | | 1/1989 | Garduno |
| D299,687 | S | | 2/1989 | Handler et al. |
| D302,088 | S | | 7/1989 | Burt |
| 4,876,970 | A | | 10/1989 | Bolduc |
| 4,953,312 | A | | 9/1990 | Astolfi |
| 4,965,896 | A | | 10/1990 | Berger et al. |
| D312,185 | S | | 11/1990 | Prater, Sr. |
| 4,972,532 | A | | 11/1990 | Juan |
| 4,978,093 | A | | 12/1990 | Kennedy |
| D313,516 | S | | 1/1991 | Socher |
| D314,112 | S | | 1/1991 | Dainty |
| D314,486 | S | | 2/1991 | Day |
| D318,307 | S | | 7/1991 | Hahn et al. |
| D322,531 | S | | 12/1991 | Hobson |
| 5,072,979 | A | | 12/1991 | Swinton |
| 5,081,724 | A | | 1/1992 | Takahashi et al. |
| 5,084,927 | A | | 2/1992 | Parkevich |
| 5,086,527 | A | | 2/1992 | Takahashi et al. |
| D325,309 | S | | 4/1992 | Worrell |
| D325,826 | S | | 5/1992 | Brunner et al. |
| D326,384 | S | | 5/1992 | Burt et al. |
| D327,786 | S | | 7/1992 | Ferrell |
| 5,161,270 | A | | 11/1992 | Najmabadi |
| D332,197 | S | | 1/1993 | Chase |
| D333,389 | S | | 2/1993 | Saito et al. |
| D333,923 | S | | 3/1993 | Dainty |
| D336,192 | S | | 6/1993 | Wedeking |
| D338,110 | S | | 8/1993 | Peay |
| 5,265,296 | A | | 11/1993 | Abbas et al. |
| D344,869 | S | | 3/1994 | McWilliams |
| 5,368,378 | A | | 11/1994 | Curtis |
| D378,966 | S | | 4/1997 | Helmsderfer |
| 5,707,126 | A | | 1/1998 | Neufeld et al. |
| D391,794 | S | | 3/1998 | Helmsderfer |
| 5,754,999 | A | | 5/1998 | Helmsderfer |
| 5,802,647 | A | * | 9/1998 | Helmsderfer ..... 5/424 |
| 5,906,015 | A | | 5/1999 | Hilger et al. |
| 6,049,928 | A | | 4/2000 | Helmsderfer |
| 6,055,688 | A | | 5/2000 | Helmsderfer et al. |
| 6,151,737 | A | | 11/2000 | Henninge |
| 6,269,503 | B1 | | 8/2001 | Betker |
| 6,859,966 | B2 | * | 3/2005 | Helmsderfer ..... 5/655 |

FOREIGN PATENT DOCUMENTS

| | | |
|---|---|---|
| GB | 638815 | 6/1950 |

* cited by examiner

BABY DIAPER CHANGING STATION

This application is a Continuation of U.S. patent application Ser. No. 10/280,698 filed on Oct. 25, 2002, now U.S. Pat. No. 6,859,966 the entire disclosure of which is incorporated herein by reference.

FIELD OF THE INVENTION

The present invention relates to an apparatus for changing the diapers of an infant or toddler.

BACKGROUND OF THE INVENTION

Apparatuses for changing the diapers of a baby or for "changing a baby" and other small children not yet toilet trained, have become widely used, such as in public restrooms, to assist a parent or other child supervisor when changing a baby's diapers. Such baby diaper changing apparatuses, often times referred to as simply baby changing stations, have taken various forms as evidenced by patents in the field, and generally take the form of a base which is mounted vertically onto a surface of a wall and a support platform or surface which is hingedly mounted to the base to hinge down from the base and lie generally horizontal to support a baby. While available baby changing apparatuses may operate sufficiently for the primary purpose of offering a generally horizontal surface on which to rest a baby during a diaper change, it is still desirable to improve upon the currently available apparatuses.

One particular drawback to existing baby changing apparatuses is the fact that most such apparatuses are fabricated of a single neutral color which, more often than not, does not match the color schemes of tile and vanity surfaces utilized within the restroom facility. Contractors, architects and the owners of public facilities often go to great lengths to present a clean and efficient restroom area with a pleasing design, decor and color scheme. Often the colors are corporate colors and are used in all restroom facilities in a particular establishment, such as a fast-food restaurant chain. Existing single color baby changing apparatuses detract from the overall decor because their large, neutral exposed surfaces clash with the colors within the restroom area. Furthermore, since the off-color baby changing apparatuses are mounted to a wall, they are particularly noticeable, further detracting from the decor. When the baby-supporting platform is in an up and closed position, a large amount of exposed surface area against the wall of the restroom presents a distinct clash with other restroom apparatuses and surfaces. Therefore, it is an objective of the present invention to present a more uniform decorative impression within a public restroom facility utilizing a baby changing apparatus.

Existing baby changing stations are also particularly subject to defacement since they are located on the walls of public restroom facilities. As noted, when the baby changing station is in the closed position, it presents a large outer surface area which somewhat invites vandalism. Vandals generally mark the outer surface with graffiti and scrape and abrade the exposed surfaces. The soft plastic of the molded station is particularly susceptible to such abrasion and other damage. As may be appreciated, such vandalism discourages use of the changing station by protective parents and further degrades the overall appearance of cleanliness within the restroom facility sending a message of neglect to users of the facility. The graffiti and vandalism is often permanent on the exposed surfaces of the changing station and requires the costly remedy of replacing an entire changing station. Therefore, it is an objective of the invention to reduce the costly and permanent damage from vandalism of baby changing stations. It is a further objective of the invention to reduce the necessity of replacing entire changing stations because of graffiti and vandalism.

Existing baby changing stations, such as those available from Brocar Products of Cincinnati, Ohio, have addressed the issues of both aesthetic appeal and vandalism by providing a changing station that utilizes a protective and decorative panel on the platform of the station. Such a panel is also set forth in U.S. Pat. Nos. 5,802,647 and 6,049,928 that are incorporated herein by reference in their entireties. When the station is in a closed position, the panel is exposed on the large bottom surface of the support platform. The panel may be any of a variety of colors to match the decor of a restroom facility. Also, the panel is made of a material, which is damage resistant. Furthermore, if sufficient vandalism occurs, it may only be necessary to replace the panel rather than the whole changer. Also, if the changing station is to be moved to a different facility, it will only be necessary to get a different color panel to match the decor of the new facility.

However, while such panels improve upon the overall look, damage resistance and practicality of changing stations, they present other issues. For example, such panels are generally incorporated with the station using a frame structure, which is riveted or otherwise secured to the changer. The frame creates various edges and crevices at its interface with the changer. Not only may such edges detract from the fit and finish, but they may also collect dirt and other foreign material. As may be expected this may degrade the appearance and perceived cleanliness of the changer. Therefore, there is still a need to improve upon the existing changing stations with respect to their durability, fit, finish and cleanliness.

Furthermore, the edge formed by the frame structure is raised, away from the surface of the changing station. Such a raised edge provides a leverage point around the changing station for the frame structure to be pried away from the changing station for further damage thereto. Therefore, it is further the objective of the invention to provide a changing station that is resistant to vandalism.

As may be appreciated, baby diaper changing stations are meant to support somewhat precious cargo, that is, an infant or toddler. Such support is generally provided several feet above a floor surface, which is often a hard surface, such as tile. Therefore, it is certainly desirable to provide for a secure attachment of the changing station, particularly to provide for a secure attachment of the base of the changing station to a wall surface. To that end, it is desirable to not only use the surface material of the wall surface, such as dry wall, but also to use strong support structures therein for supporting the changing station.

Typically, blocking is utilized in the wall area where a changing station is to be mounted. Such blocking, which includes the addition of both vertical and horizontal support structure being added to the wall, in addition to the existing support structures, such as 2×4's, requires special measures. For example, usually the location for the changing station in the facility must be preselected. Then, drawings must be accordingly adjusted to indicate to a contractor the area for blocking. Finally, the additional work has to be done to block a particular area. Such extra measures increase the overall cost of constructing or retrofitting the facility, but may be required for ideal securement and for spreading the load of the changing station over the support structures. In addition to the extra costs and time, such blocked areas are generally preselected and, thus, do not allow for mounting flexibility based upon field conditions. If the changing station is to be moved, then another area has to be blocked, additional drawings have to be made, etc., further driving up costs.

Therefore, it is desirable to provide a station that is readily mounted to a wall surface without overly complicated and time-consuming blocking procedures. It is further desirable to provide mounting flexibility in the field.

These objectives and other objectives of the present invention are discussed in further detail below.

SUMMARY OF THE INVENTION

The diaper changing station, in accordance with the present invention, includes a base and a support platform hingeably mountable to the base to move between an opened and a closed position against a wall. The support platform has an upper surface for supporting a child and has a bottom surface and side surfaces there between. The bottom surface is exposed when the support platform is moved to a closed position.

In accordance with one aspect of the invention, a panel is configured to overlie and cover at least a portion of the bottom surface. The panel is generally exposed when the support platform is in the closed position. A frame structure is configured to engage the bottom surface and side surfaces of the support platform for securement thereto. The frame structure is configured to secure the panel with the support platform when the frame structure is coupled to the support platform. A lip is formed around at least one of the side surfaces of the platform, and preferably around all the exposed side surfaces. An edge of the frame structure abuts the lip when the frame structure engages the support platform. In that way, a seamless appearance and construction, which improves the aesthetics, cleanability, and overall integrity of the diaper changing station, is presented.

In accordance with another aspect of the present invention, a support platform might be utilized generally without a lip. The frame structure is configured to engage the bottom and side surfaces of the support platform for securing the panel. A molding element engages an edge of the frame structure, and is tapered at an edge thereof to meet a surface of the frame structure or a surface of the support platform. In one embodiment, the opposing edges of the molding element are tapered for tapering down to and engaging both the surface of the frame structure and the surface of the support platform to present a seamless appearance.

In accordance with yet another aspect of the present invention, the base includes a backer plate, which is configured for mounting to a wall, and specifically to studs in a wall. The backer plate has a cleat and is oriented to form generally a horizontal ledge with the cleat. Another backer plate is coupled with the base of the diaper changing station and has a cleat positioned thereon to engage and oppose the cleat of the wall backer plate. The engaging cleats of the opposing backer plates provide support of the base on the wall when the diaper changing station is mounted to the wall. The backer plates ensure that the station may be mounted to wall studs despite its location and without the need for specialized blocking. The backer plates further enhance the support provided by other fastening structures utilized to affix the diaper changing station to the wall.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION

Figure 1A:
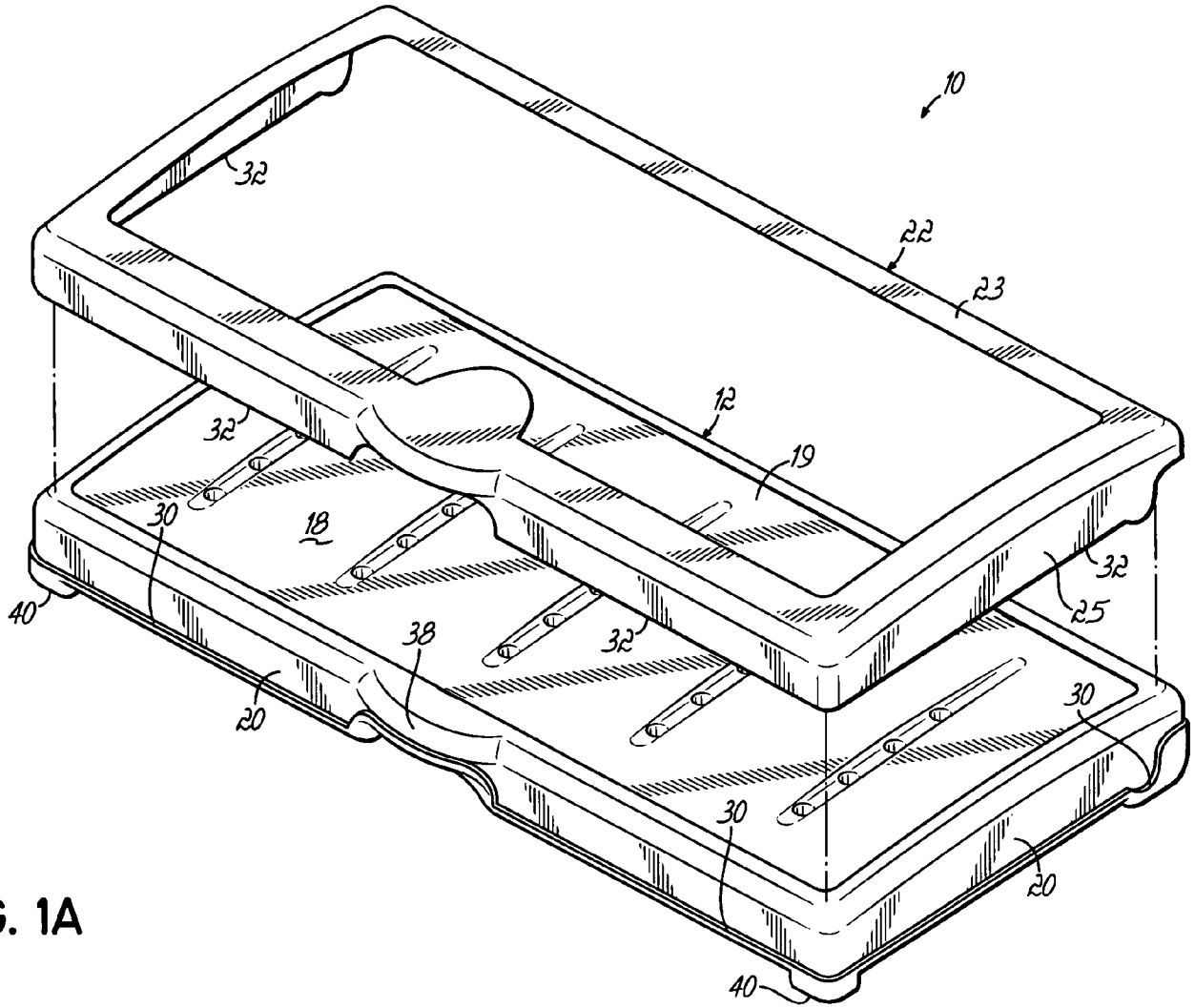
FIG. 1A is an exploded perspective view of an embodiment of the invention.
Figure 3:
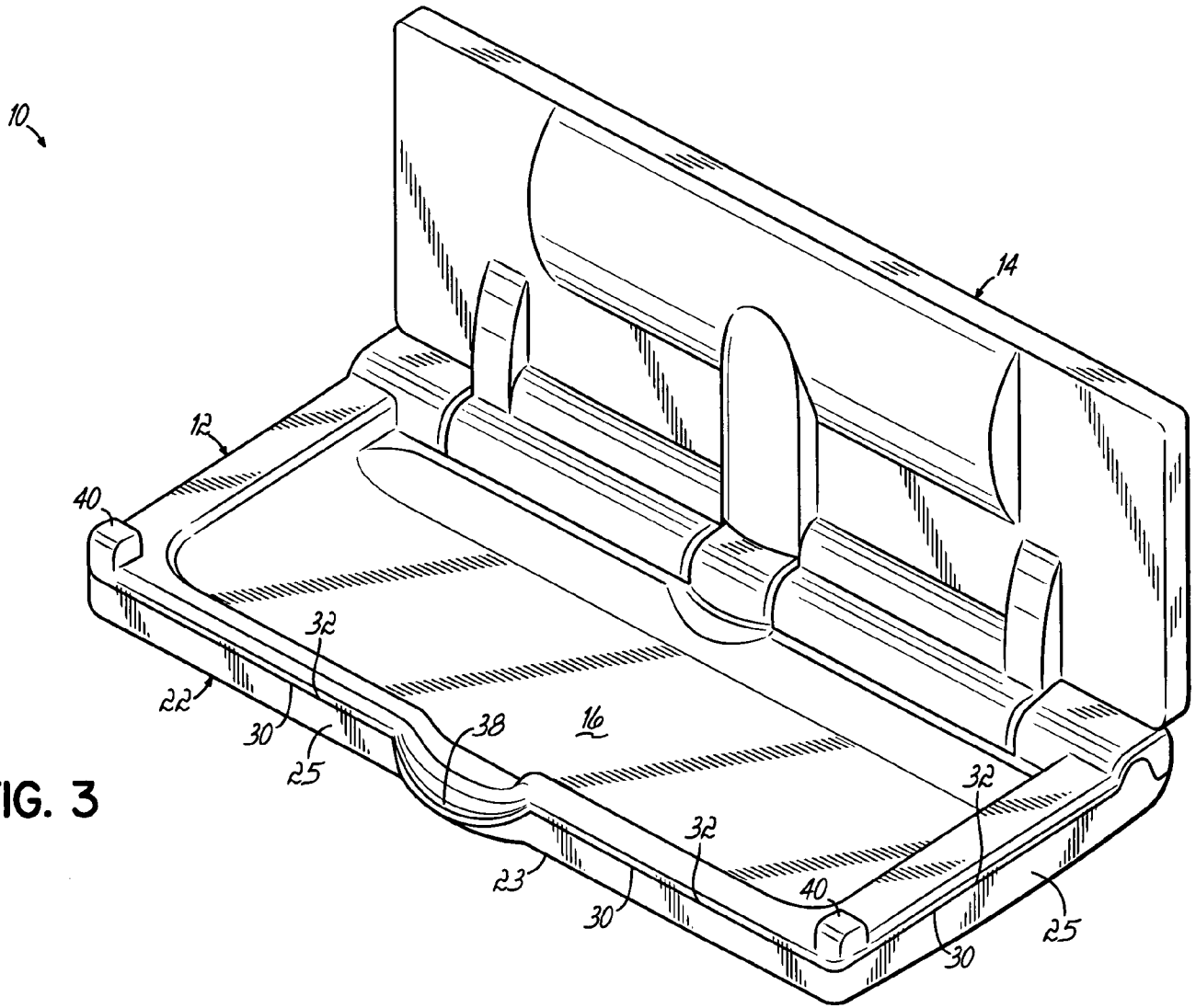
FIG. 3 is a perspective view showing an embodiment of the invention in an open position.

FIG. 1A illustrates a portion of a baby diaper changing station 10 in accordance with one aspect of the present invention. Specifically, station 10 shows a support platform 12, which is appropriately formed to be hingeably fixable, or otherwise secured, at an edge thereof with respect to a wall surface, and specifically with respect to a base 14, as illustrated in FIG. 3. The base 14 is mounted to a wall surface. The support platform moves between an open position for use (see FIG. 3) and a closed position up against a wall surface, as is typical in the art. The support platform, in one example, might be molded with an appropriate plastic, such as high-density polyethylene (HDPE). The support platform generally includes a top surface 16, bottom surface 18, and side surfaces 20. The top surface, when the support platform is in the open position as illustrated in FIG. 3, is oriented generally horizontally and is configured for supporting a child, such as an infant or a toddler, above a floor to facilitate a diaper change.

Figure 2A:
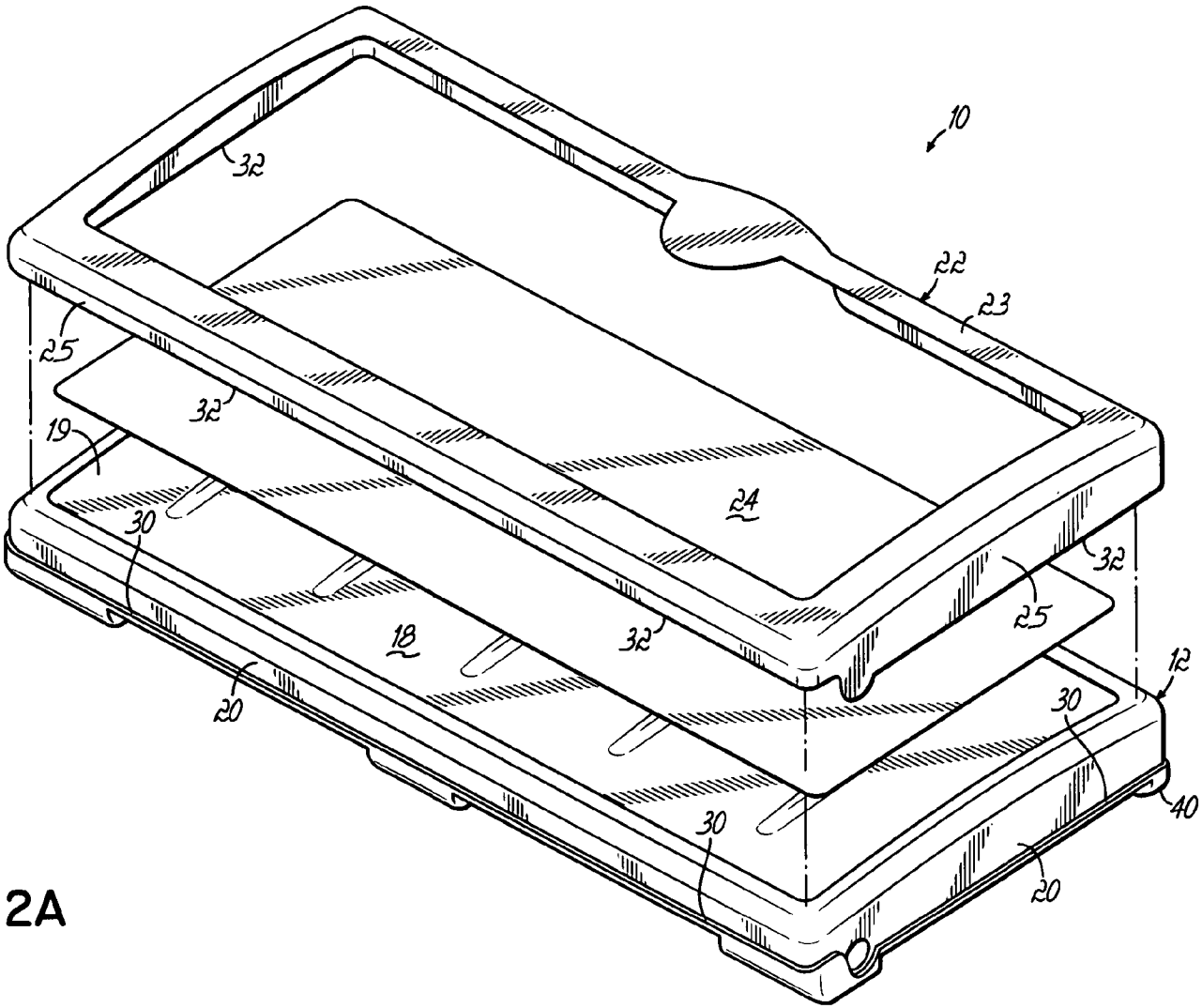
FIG. 2A is an exploded perspective view of an embodiment of the invention showing a panel.
Figure 2B:
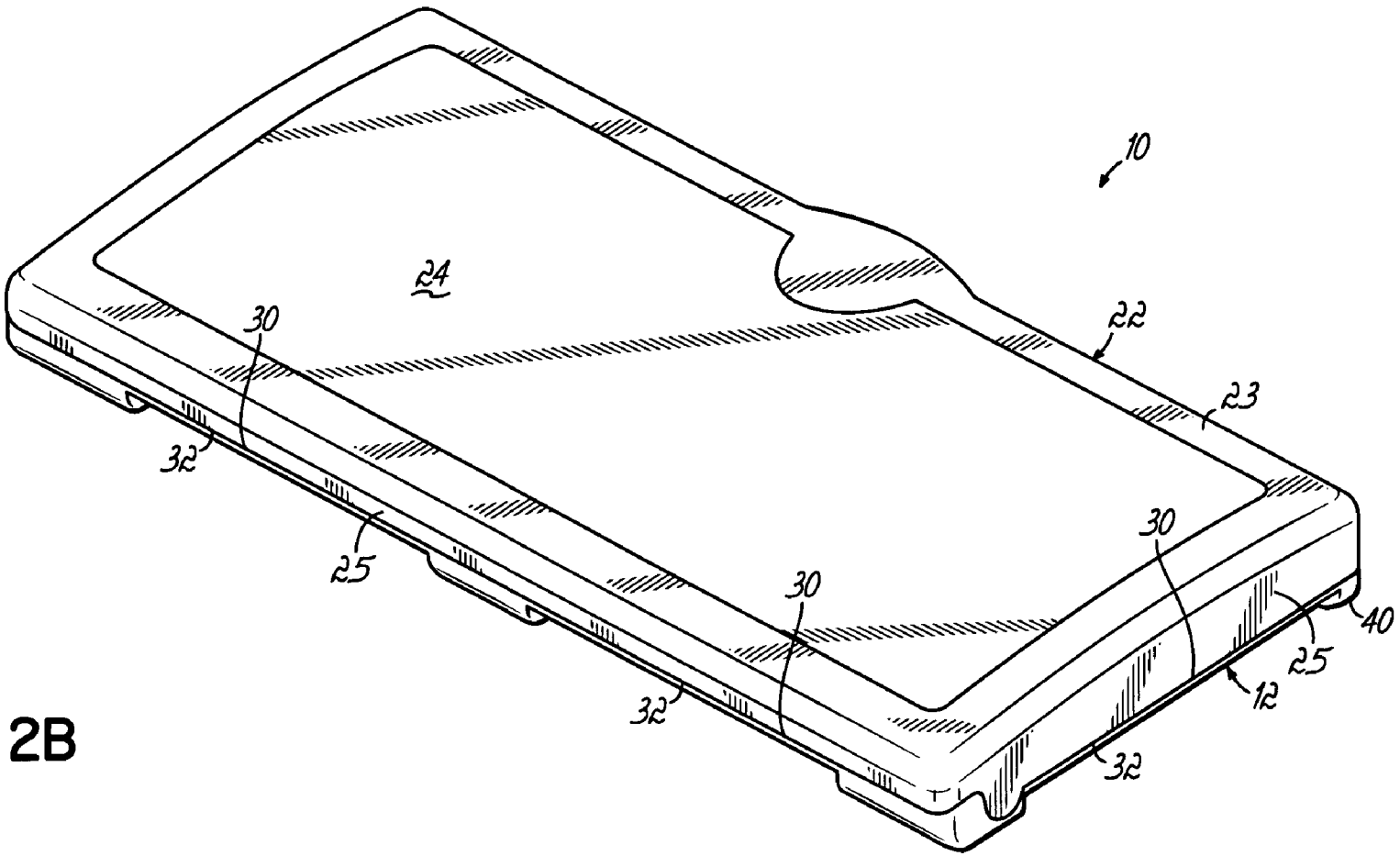
FIG. 2B is a perspective view of a support platform with the panel affixed thereto by a frame structure in accordance with the invention.

In accordance with one aspect of the present invention, a frame structure 22 is configured to engage the bottom surface 18 and side surfaces 20 of the support platform for securement thereto. While the frame structure provides desirable fit and finish aesthetics with respect to the changing station, the frame structure is also utilized in securing a decorative panel 24 to the support platform, as illustrated in FIGS. 2A and 2B. The panel 24 may be formed of a suitable laminate that is available in a wide variety of colors. Alternatively, the panel 24 might be formed of a metal, such as stainless steel. Bottom surface 18 includes an insert area 19 for receiving the panel 24.

In the closed position, the bottom surface of the support platform is exposed, and the panel 24 provides a desirable color to the bottom surface for aesthetic purposes. For example, the color of the panel may be made to match the decor of the restroom or other facility where the changing station 10 is mounted. Similarly, a metal panel, such as a stainless steel panel, might be utilized for aesthetic purposes, to match the other stainless steel and metal fixtures within a facility. In addition to providing an aesthetic appeal, the panel also provides protection for the changing station, such as from vandalism. Graffiti on the panel may be wiped clean. If damage is sufficient to ruin the panel, the panel might be readily replaced by removing the frame structure and installing a new panel. The panel is preferably sized to cover a significant portion of bottom surface 18.

The invention, in one aspect, provides several advantages over the prior art. Specifically, the support platform and frame structure are configured for coupling together to effectively reduce a raised seam and also to reduce the cleanability problems created where the frame structure joins the support platform. Furthermore, the invention provides a more streamlined appearance and improved fit and finish by eliminating the raised edge, which was an aesthetic detraction. Still further, reducing the raised edge associated with the seam makes the unit more impervious to vandalism, such as where someone may try to pry or separate the frame structure from the support platform.

Figure 1B:
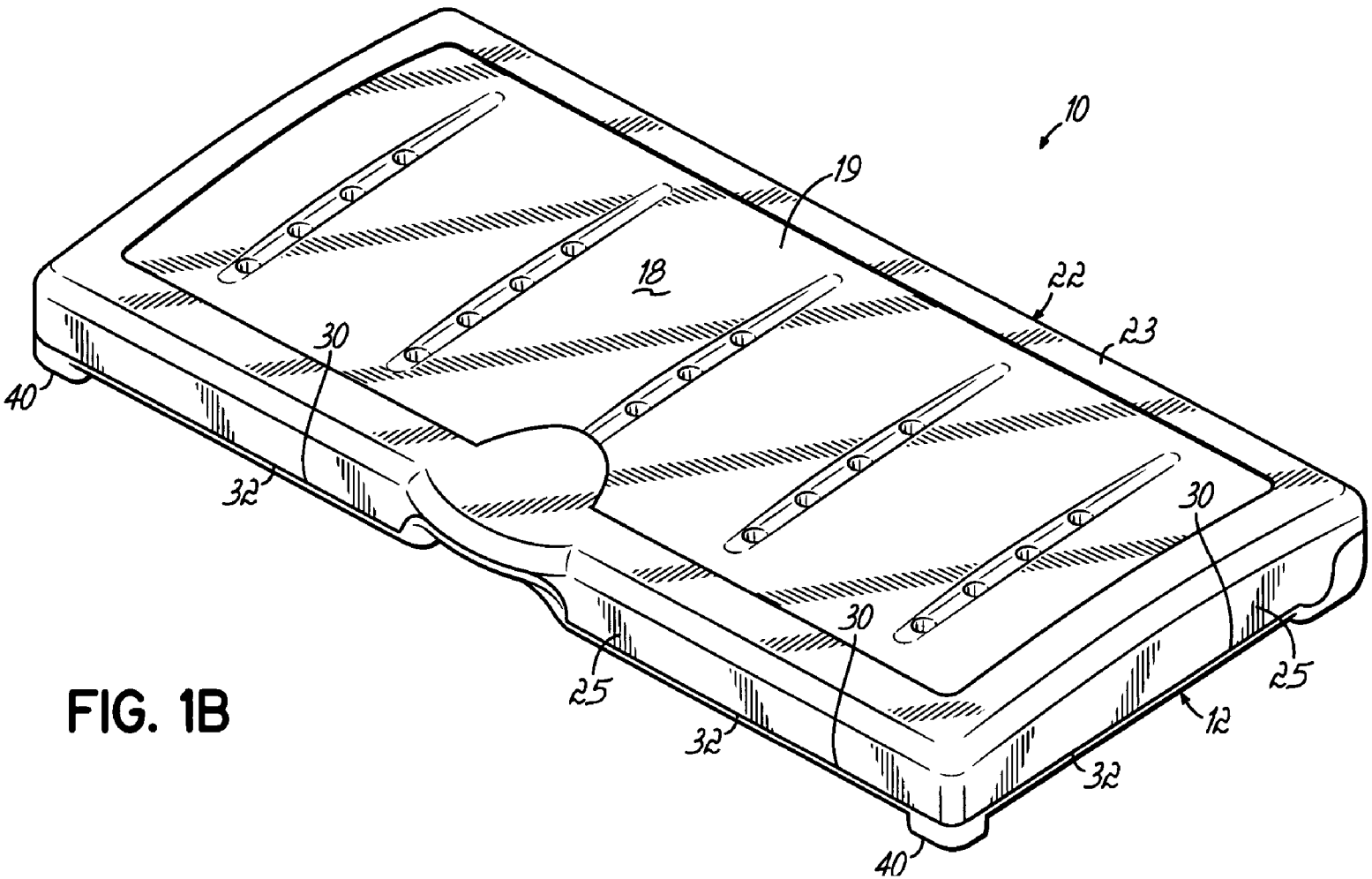
FIG. 1B is a perspective view showing the frame structure affixed to a support platform of the invention.

Referring to FIG. 1A, the frame structure 22 is configured to engage the bottom surface and side surfaces of the support platform 12 for securement thereto. The frame structure includes a frame 23 and an integrated flange 25. In accordance with one aspect of the present invention, a lip 30 is formed around at least one side surface of the platform 12, and preferably around all the exposed side surfaces 20 which might be visible when the platform is in the open position or closed position. In one embodiment, the lip 30 might be formed by being molded with the support platform. Referring to FIGS. 1A and 1B, the frame structure has an opposing edge 32 formed generally by flange 25 which abuts the lip 30 when the frame structure engages a support platform. As illustrated in FIG. 1B, such an abutment provides a generally seamless appearance to the finished support platform. In one embodiment, the lip 30 is configured to have a height, which generally matches the thickness of flange 25 so that a raised edge is reduced or eliminated. In one embodiment, the lip 30 is configured to have a height, which generally matches the thickness of flange 25 so that a raised edge is reduced or eliminated. The abutting edge 32 of the flange and lip 30 provide a thin, tight seam, which reduces the collection of any dirt and enhances the cleanability of the changing station. Furthermore, the seamless appearance is also aesthetically desirable and improves the fit and finish of the product. Still further, the somewhat flush, seamless engagement between the frame structure and support platform deters vandalism, by making the separation of the frame structure 22 and panel 24 from the support platform more difficult.

As is illustrated in FIGS. 1A-2B, the lip 30 and edge 32 are shaped, generally as mirror images, for close abutment and the desired seamlessness. Once in position, the frame structure may be held in place and secured to the support platform, by rivets, adhesives, or other suitable securement methods. As illustrated in FIGS. 2A and 2B, once secured, the frame structure, and particularly frame 23, secures the panel 24 with the support platform 12. The shape of the lip and the edge of the frame structure are not limited to those shown in the drawings. Rather, various shapes of those components may be varied as desirable for addressing features of the components. In one embodiment, the lip 30 and flange edge 32 extend around at least three sides of the support platform and preferably around all four sides. Furthermore, the cooperating edge 32 and lip 30 may be shaped to configure with features of the support platform. For example, the shape of the lip 30 and edge 32 are appropriately formed to address the handle 38 formed on the support platform as illustrated in FIGS. 1A-1B.

Turning now to FIG. 3, the support platform 12 is shown hingedly coupled to base 14 which would be secured to a wall as discussed further herein below. The support platform 12 and base 14 have portions that cooperate to form the appropriate hinge structure to allow the support platform to be moved between an open position and a closed position. FIG. 3 illustrates the support platform in an open position with surface 16 available for supporting a child. The support platform, may have other features, such as hooks 40 for securing a purse, diaper bag, coat, or other item, while the baby's diaper is being changed, to keep such items off of the floor.

Figure 4:
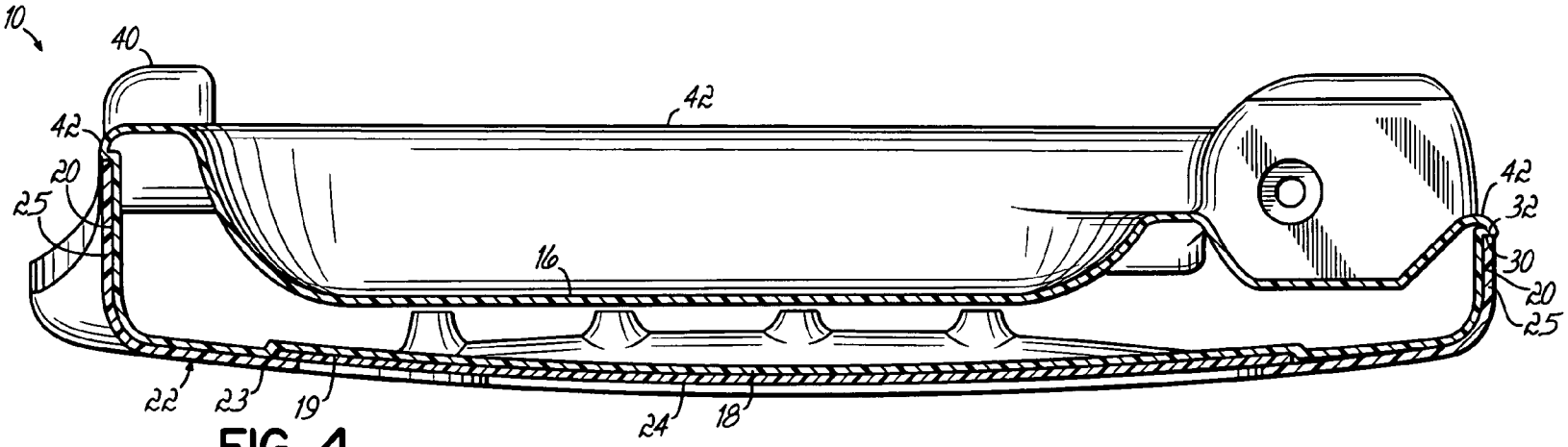
FIG. 4 is a side cross-sectional view showing an embodiment of the present invention.
Figure 5:
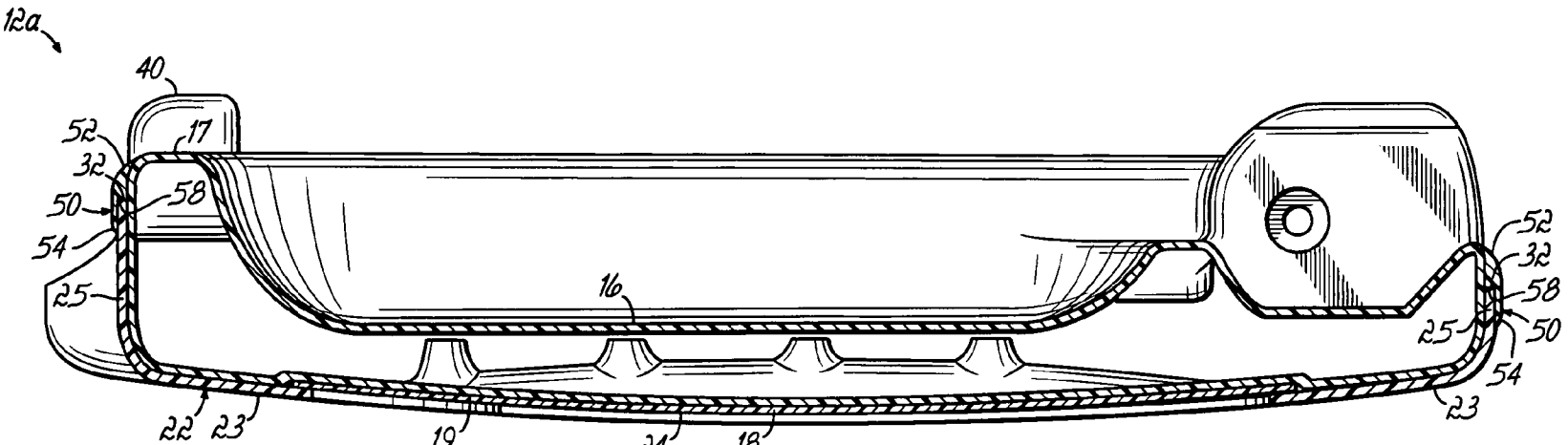
FIG. 5 is a side cross-sectional view showing an alternative embodiment of the present invention.

FIG. 4 illustrates a side cross sectional view of the support platform according to the principles of the present invention. Thereon, the lip 30 is illustrated coupled with the edge 32 of the frame structure. As shown, the abutting lip 30 and edge 32 have a very small seam, which essentially creates a seamless appearance for the structure. As noted above, such a seamless appearance is desirable from an aesthetic, sanitary, and vandalism standpoint. In the above illustrated FIG. 4, the top surface 16 of support platform transitions smoothly to the lip 30 along the upper edge 42 of the support platform. Such a smooth transition to the seam area reduces the possibility that the seam will collect dirt while providing a desirable finished product, which may be readily wiped clean. As noted above, the depth or height of the lip 30 is preferably around the thickness of the flange 25 forming edge 32, so that the lip and edge are flush, and the seam is smooth.

n accordance with another aspect of the present invention, an alternative embodiment of the changing station 10, specifically support platform 12, is illustrated in FIG. 5 and indicated as 12*a*. Support platform 12*a* utilizes a retrofit with a frame structure of a support platform which does not include a lip, in order to achieve the desired aesthetic fit and finish, damage resistance, and cleanability of the embodiments illustrated in FIGS. 1A-4. Specifically, as illustrated in FIG. 5, where like numbers indicate like elements, the support platform 12*a* is not formed with a lip. When the frame structure 22 engages the bottom surface 18 of the support platform and the flange 25 engages the side surface 23, an upstanding edge would normally be formed at the interface. As noted above, such an edge is undesirable for a variety of reasons. In accordance with another embodiment of the invention, a molding element 50 is configured to engage an edge 32 of the frame structure and to simultaneously engage the side surface 23. The molding element is tapered at an edge thereof, and preferably at both an upper edge 52 and a lower edge 54. The respective tapers are formed down to the respective surfaces of the frame structure 22 and support platform 16 to which the molding element is coupled. Specifically, with respect to FIG. 5, one tapered edge 54 of the molding element 50 couples with the frame structure 22, and thus slopes or tapers down to a surface of the frame structure. Similarly, edge 52 tapers to meet a surface 17 along the upper edge of the top surface 16 as illustrated in FIG. 5. As may be appreciated, the width or height of the molding element might be varied, such as to cover more of the flange 25 or more of the support platform surfaces. The molding element 15 includes a shoulder 58 which abuts with edge 32 when the molding element is coupled with the support platform and frame structure. In that way, a generally seamless appearance is presented and small, tight seams at edges 52, 54 are provided which are resistant to collecting dirt. Furthermore, the smooth tapering provides improved cleanability and improved fit and finish to the product. The molding element 50 may be secured in place by rivets, adhesives, or other fastening methods. The molding element might be formed by being extruded or might also be machined.

Figure 6:
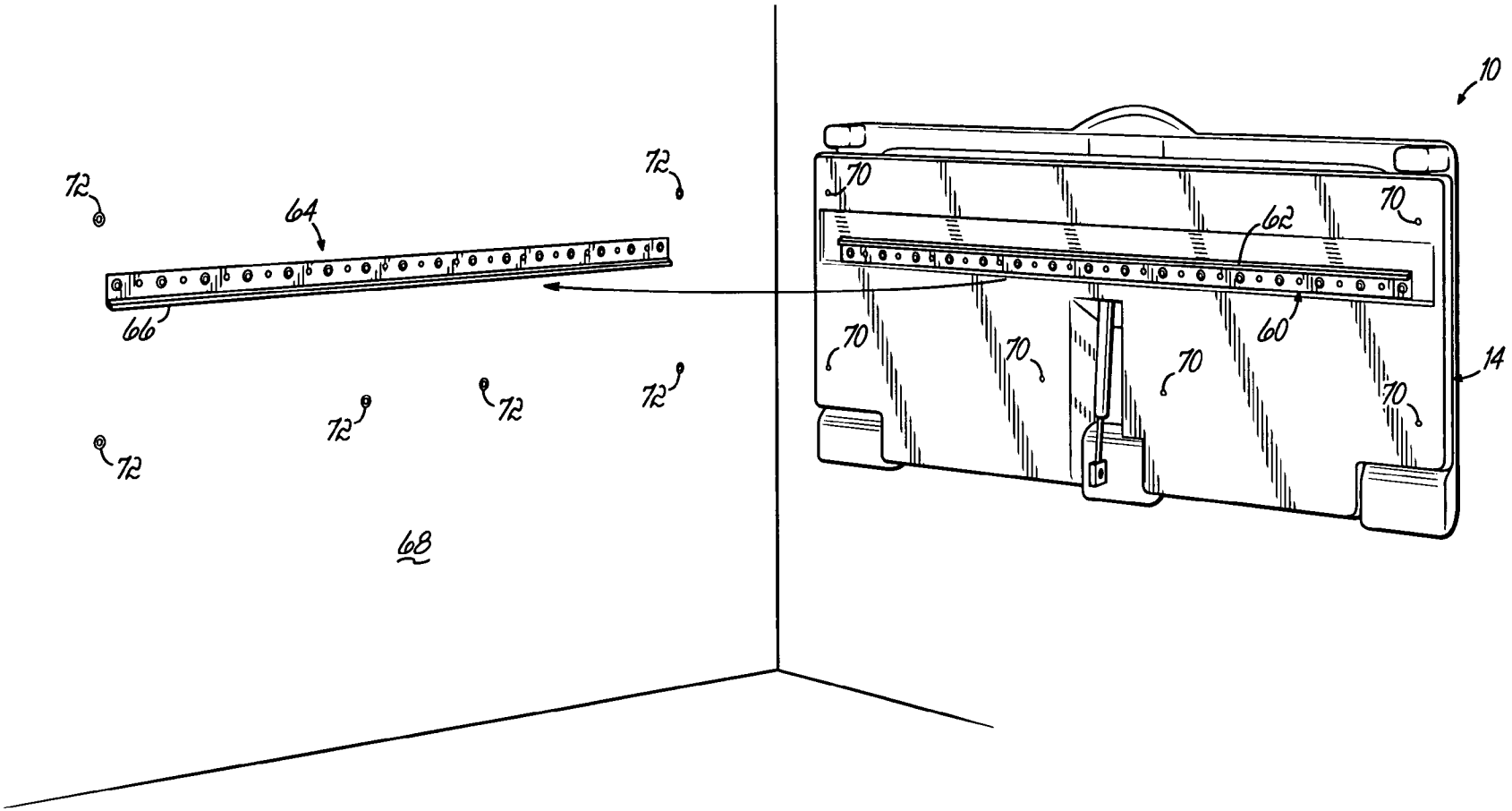
FIG. 6 is a perspective exploded view showing the backer plate feature of the present invention.
Figure 7:
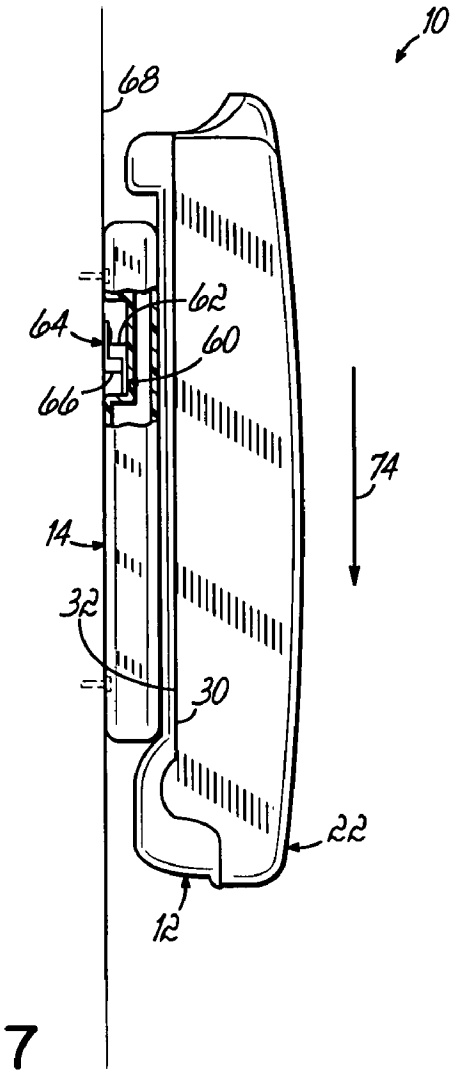
FIG. 7 is a side view, partially cut away, showing an embodiment of the invention mounted to a wall surface.

FIGS. 6 and 7 illustrate another aspect of the present invention. The changing station 10 may incorporate a backer plate 60 having a cleat 62 formed thereon. The backer plate 60 works in cooperation with another backer plate 64 having a cleat 66 thereon. Backer plate 64 is mounted to a wall surface 68 as illustrated in FIGS. 6 and 7. The backer plates 60, 64 provide improved support for the changing station 10 on a wall surface 68.

In accordance with one aspect of the present invention, the cleat 62 on the plate 60 of the changing station 10 abuts or otherwise couples with the cleat 66 on the wall-mounted plate 64. The backer plate 60, in one embodiment, is screwed, bolted, or otherwise fixed to the changing station 10, such as by being fixed to base 14. In another embodiment, the backer plate may be integrally incorporated with the base. The base 14 is formed with a suitable indent or recess 15 therein to receive plate 60. The recess 15 allows for flush mounting of the base to the wall as shown in FIG. 7. As illustrated in FIGS. 6 and 7, backer plate 64 is appropriately positioned on the wall to engage one or more studs (not shown) or other sturdy structures in the wall and is affixed to the stud or the structure at least at two points, such as with screws, lag bolts, or other appropriate fasteners. As illustrated in FIGS. 6 and 7, the backer plate 64 is positioned such that the cleat 66 is along the bottom edge to form a ledge to receive the changing station 10. Backer plate 60 is appropriately affixed to the base 14 of changing station 10 so that the cleat 62 forms generally a horizontal ledge 62 along the edge of the backer plate 60.

Referring to FIG. 7, during installation, the changing station 10 is brought into a position such that the respective cleats 62, 66 and the ledges they form engage and a portion of the weight of the diaper changing station and the occupant is taken on by cleat 66 and backer plate 64 and, therefore, by the wall studs. In that way, the support of the changing station on the wall surface is enhanced in addition to other mounting fasteners utilized to secure the base 14 to the wall surface 68. The backer plates 60, 64 provide strong support for the changing station and thus further enhance the mounting of the station. Once the opposing cleats are in position and the base 14 is hung from the backing plate 64 by the engagement of the cleats 62 and 66, the base may be further secured into wall surface 68 by appropriate fasteners, such as screws or lag bolts. In the embodiment illustrated in FIG. 6, six fastener openings are shown and designated as 70 on the base 14 and 72 on the wall.

The opposing backer plates and cooperating cleats 62, 66 provide enhanced securement of changing station 10 to the wall surface 68.

The backer plates of the invention also reduce or eliminate the need for blocking. Utilizing the backer plates 64 on the wall, the changing station 10 is ensured of being mounted with the load spread at least to two studs or other support structures. Therefore, blocking may not be necessary. As such, the extra time and cost associated with blocking drawings and installation of the blocking may be eliminated.

Furthermore, the present invention provides greater mounting flexibility to adapt to field conditions. For example, if the location of the changing station is changed, the backer plates 64 may be readily moved and mounted to studs at the new location without the requirement for blocking. Conventionally, if the location of the changing station varied, the old location, which would probably have been previously blocked, is no longer utilized and blocking, along with associated drawings, would have to be used for the new location. This would increase the delays and costs associated with mounting the changing station. Now, such delays and costs are eliminated by the invention.

The changing station is also better able to handle increased downward force as illustrated in FIG. 7 with arrow 74, such as the downward force provided by a heavy toddler or other items which might be placed on the support platform 12 when it cantilevers away from the wall in the open position.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A diaper changing station for mounting on a wall surface above a floor surface comprising:

a support platform configured for supporting a child and having a closed position generally parallel against the wall surface and an open position generally parallel with the floor surface, the support platform having a top, child-supporting surface, a bottom surface normally exposed on the wall when the support platform is in the closed position and side surfaces that span between the top and bottom surfaces;

a panel structure for covering the support platform bottom surface and being configured to engage and directly overlie the bottom surface and side surfaces of the support platform to be exposed over the bottom surface when the support platform is in the closed position;

a lip formed around at least one side surface of the support platform between the top and bottom surfaces, the lip being continuous with one of the top or bottom surfaces and forming a substantially horizontal surface when the support platform is in the open position;

an edge of the panel structure abutting the lip when the panel structure engages the support platform.

2. The changing station of claim 1 wherein the lip extends around at least three side surfaces of the platform and the edge of the panel structure abutting the lip.

3. The changing station of claim 1 wherein the panel structure includes a flange, the edge of the flange abutting the lip.

4. The changing station of claim 3 wherein the panel structure flange is sized to cover a significant portion of the sides of the support platform.

5. The changing station of claim 1 wherein the panel structure covers a significant portion of the bottom surface.

6. The changing station of claim 1 further comprising a base, the support platform coupled to the base.

7. The changing station of claim 1 wherein the panel structure is metal.

8. A diaper changing station for mounting on a wall surface above a floor surface comprising:

a support platform configured for supporting a child and having a closed position generally parallel against the wall surface and an open position generally parallel with the floor surface, the support platform having a top, child-supporting surface, a bottom surface normally exposed on the wall when the support platform is in the closed position and side surfaces that span between the top and bottom surfaces;

a structure for engaging the support platform, the structure including a panel portion configured to directly overlie the bottom surface and a frame portion configured to cover the side surfaces of the support platform, the structure panel portion exposed over the bottom surface when the support platform is in the closed position;

a lip formed around at least one side surface of the support platform between the top and bottom surfaces and being continuous with one of the top or bottom surfaces and forming a substantially horizontal surface when the support platform is in the open position;

an edge of the frame portion abutting the lip when the structure engages the support platform.

9. The changing station of claim 8 wherein the frame portion includes a flange, the edge of the flange abutting the lip.

10. The changing station of claim 8 wherein structure, including the panel and frame portions, is metal.

11. A diaper changing station for mounting on a wall surface above a floor surface comprising:

a support platform configured for supporting a child and having a closed position generally parallel against the wall surface and an open position generally parallel with the floor surface, the support platform having a top, child-supporting surface, a bottom surface normally exposed on the wall when the support platform is in the closed position and side surfaces that span between the top and bottom surfaces;

a structure configured to engage the bottom and side surfaces of the support platform for directly overlying the bottom surface to be exposed over the bottom surface when the support platform is in the closed position;

a molding element configured to engage an edge of the structure between the top and bottom surfaces, the molding element including a shoulder forming a substantially horizontal surface when the support platform is in the open position, the edge of the structure engaging the shoulder;

the molding element being tapered at an edge thereof to meet at least one of a surface of the structure and a surface of the support platform to cover a seam between the structure edge and the support platform.

12. The changing station of claim 11 wherein said molding element includes opposing tapered edges for simultaneously meeting a support platform surface and a surface of the structure.

13. The changing station of claim 11 wherein the molding element has a generally smooth surface between said tapered edges.

* * * * *